United States Patent [19]

Harfst

[11] Patent Number: 4,873,903

[45] Date of Patent: Oct. 17, 1989

[54] SAW CHAIN WITH WEAR LINK

[75] Inventor: Michael D. Harfst, Milwaukie, Oreg.

[73] Assignee: Blount, Inc., Montgomery, Ala.

[21] Appl. No.: 216,191

[22] Filed: Jul. 7, 1988

[51] Int. Cl.[4] ..... B27B 33/14

[52] U.S. Cl. ..... 83/830; 83/834

[58] Field of Search ..... 83/830, 831, 832, 833, 83/834; 30/381, 383; 144/72, 73; 125/21; 56/244, 290

[56] References Cited

U.S. PATENT DOCUMENTS

| | | | |
|---|---|---|---|
| 2,508,784 | 5/1950 | Cox | 83/834 |
| 2,801,653 | 8/1957 | Van Wagner | 83/831 |
| 2,897,857 | 8/1959 | Carlton . | |
| 3,548,897 | 12/1970 | Ekrud . | |
| 3,854,363 | 12/1974 | Merkell et al. . | |
| 3,987,543 | 10/1976 | Ratz et al. | 30/383 |
| 4,211,136 | 7/1980 | Geurian | 83/830 |
| 4,459,890 | 7/1984 | Dolata et al. . | |
| 4,768,289 | 9/1988 | Apfel et al. | 30/383 |

FOREIGN PATENT DOCUMENTS

SU 1115901 A 9/1984 U.S.S.R. .

OTHER PUBLICATIONS

Omark Industries, Drawing No. 13037, 12/12/1977.

*Primary Examiner*—Frank T. Yost
*Assistant Examiner*—Eugenia A. Jones
*Attorney, Agent, or Firm*—Klarquist, Sparkman, Campbell, Leigh & Whinston

[57] ABSTRACT

Saw chain is assembled with wear links for improving the resistance of saw chain to abrasion from the saw bar. In one embodiment, the wear links are mounted one beside each steel side link in the chain and are constructed to ride along the outer surfaces of the pair of parallel rails upon which the side links also ride as the chain is driven around the bar. The wear links, however, are formed of a material that better resists abrasion than steel but consequently has less tensile strength. To assure that the tensile load on the chain is assumed by the steel side links while the chain is supported on the bar by the wear links, the wear links have oblong pin openings of the same height but of greater length than the circular openings of the side links. In a second embodiment, the wear links are mounted on both sides of each drive link rather than beside each side link.

11 Claims, 1 Drawing Sheet

SAW CHAIN WITH WEAR LINK

BACKGROUND OF THE INVENTION

This invention relates to saw chain and, more particularly, to an improved construction of a saw chain to improve the chain's resistance to abrasion by the saw bar.

Conventional saw chain includes a series of links pivotally interconnected by rivets or pins. This series of links includes center drive links and side links, the drive links having depending drive tangs and the side links including cutter links and tie links or tie straps. When mounted on a chain saw bar, the tangs of the drive links ride in a groove centered longitudinally in the bar and the undersides of the side links run on the bar's outer parallel rails that define the groove.

A drawback of present chain is the tendency of the underside of the side links riding on the saw bar rails to abrade away or deform. Such links are preferably formed of a high tensile strength steel capable of accepting the tensile loads imposed on a chain. Such steel does not, however, resist abrasion well. As a result, the useful life of the saw chain is frequently foreshortened by the wear on the surfaces contacting the saw bar. Prior attempts to reduce the wear rate on the underside portions of these links have focused on reshaping the links or forming them of a material that is more wear resistant than steel. For example, U.S. Pat. No. 2,897,857 discloses saw chain links wherein the edge portions in engagement with the saw bar were of greater width than the remaining part of the link. U.S. Pat. No. 3,548,897 teaches reduced wear by providing a forwardly directed deflector on each cutter link. The deflectors produce balanced action in the movement of the links along the rails of the saw bar. This balanced action results in uniform wear on the undersides of the cutter links. U.S. Pat. No. 4,459,890 discloses a safety projection on at least some of the drive links. These safety projections provide a lever action that causes the cutter links to engage the workpiece in a controlled manner. Russian Pat. No. SU 1115901 A discloses a manufacturing process that orients the cutter tooth of the cutter link in an angular position relative to the direction in which the material strip has been rolled to provide greater toughness and resistance to wear. U.S. Pat. No. 3,854,363 discloses a material for side links of harder composition than conventional carbon steel and prior low alloy steel. This harder composition is said to provide greater wear resistance.

Neither approach has worked particularly well. Changing the shape of the links to promote uniform wear still expose the undersides to abrasion from the bar rail. The use of a harder material, on the other hand, improves abrasion resistance, but the increased hardness reduces tensile strength and can lead to premature breaking of the chain.

SUMMARY OF THE INVENTION

A principal object of the invention is to provide a saw chain having an improved useful life.

A further object of the invention is to provide an improved saw chain that better resists abrasion by a saw bar.

Another object of the invention is to improve the wear resistance of a saw chain without sacrificing the chain's tensile strength.

Another object of the invention is to provide a means which can be easily added to presently designed saw chain for improving its resistance to abrasion.

In accordanc3e with the illustrated embodiments, the present invention provides wear links positioned to engage the saw bar rails and support the chain thereon, the wear links being paired with other links of the chain. To better resist abrasion, the wear links are formed of a more abrasion resistant material than the steel of the other links. This material, however, has a lesser tensile strength than steel. To assure that the steel links assume the tensile load on the chain, the wear links have oblong pin openings of the same height as the pin openings of the side links but of greater length so as to support the chain on the bar but accept none of the tensile load.

The foregoing and other objects, features, and advantages of the invention will become more apparent from the following detailed description of preferred embodiments which proceeds with reference to the accompanying drawings.

DETAILED DESCRIPTION

Figure 2:
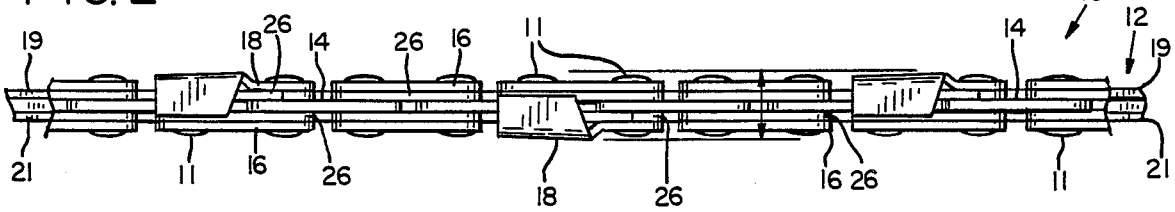
FIG. 2 is a top plan view of the saw chain shown in FIG. 1.
Figure 1:
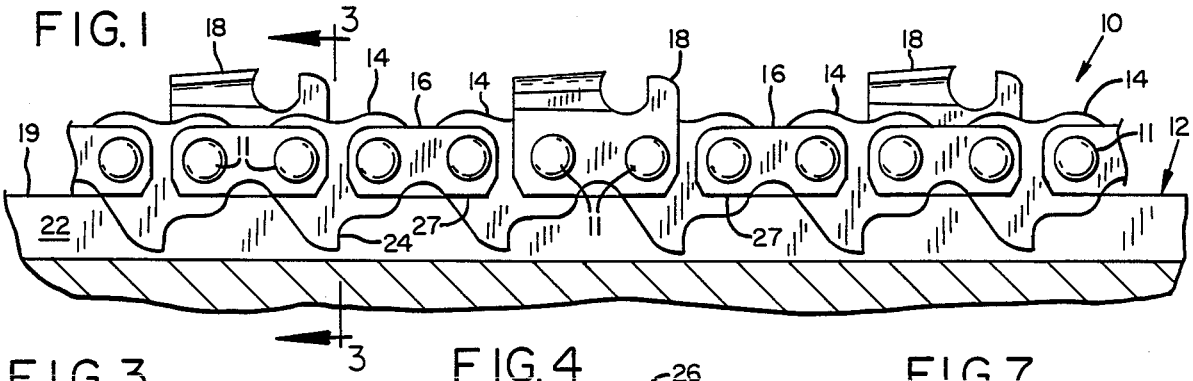
FIG. 1 is a side view, partly in section, of a saw chain constructed in accordance with the invention in position on a saw bar.
Figure 3:
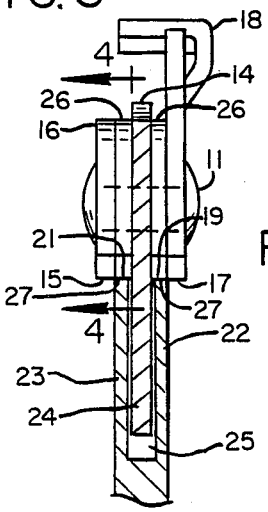
FIG. 3 is an enlarged cross-sectional view taken along line 3—3 of FIG. 1.

Referring to FIGS. 1–3, a portion of a saw chain 10 is shown mounted on a linear portion of a saw bar 12. The saw chain 10 is constructed of chain links that include a series of drive links 14 and side links comprising tie links 16 and cutter links 18, all pivotally interconnected by rivets or pins 11 extending through circular openings in the links, which openings have a diameter a few thousandths of an inch greater than the pin diameter. As best seen in FIG. 3, the respective undersides 15 and 17 of the tie links 16 and cutter links 18 are spaced apart from the respective outer surfaces 19 and 21 of rails 22 and 23 of the saw bar 12 by the presence of wear links 26. In a conventional saw chain, the wear links 26 are absent and the undersides 15 and 17 are in frictional contact with the rail surfaces 19 and 21 as the chain 10 is driven around the bar 12. The depending tangs 24 of the drive links 14 ride freely in a center groove 25 defined by the rails 22 and 23 for driving engagement of the chain 10 with the sprocket (not shown) of the chain saw motor in a conventional manner. The links 14, 16, and 18 may be made of suitable high tensile strength steel, for example, Type NS801, known as saw chain steel. A saw chain as thus described is similar to a chain such as shown in Cox, U.S. Pat. No. 2,508,784.

In accordance with the invention, paired with and mounted beside each tie link 16 and cutter link 18 is a wear link 26. The underside 27 of the wear link 26 has a contour that matches the contour of the undersides 15 and 17 of the links 16, 18. A wear link 26 is mounted between each drive link 14 and adjacent paired side link. The wear links 26 are made of a more abrasion resistant material than the steel of the side links 16, 18. A suitable material is the cobalt chromium alloy sold under the trademark STELLITE 6B. STELLITE 6B is more abrasion resistant than steel to resist better the abrasion by the rails 22 and 23. But STELLITE 6B has lower tensile strength than steel and thus is less capable of absorbing the jarring and tension to which saw chain is subjected as it is driven around a saw bar.

Figure 4:
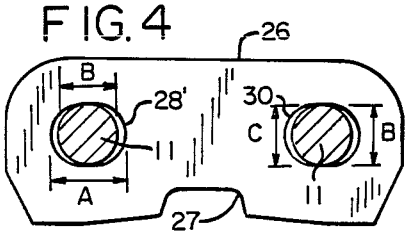
FIG. 4 is a cross-sectional view taken along line 4—4 of FIG. 3.

To take advantage of the increased resistance of the wear links 26 without sacrificing the chain's tensile strength, the wear links are constructed to ride on the rail surfaces 19 and 21 and support the other chain links without assuming the tensile load on the chain 10. To this end, each wear link 26 is formed with a pair of oblong pin openings 28 and 30, as shown in FIG. 4, to receive the pins 11. The center-to-center distance between the openings 28, 30 is the same as that of the openings in the side links 16, 18. However, the longitudinal axis or length 'A' of each opening 28, 30 extending longitudinally of the chain is greater than the diameter "B" of the circular pin openings in the tie links 16 and cutter links 18. Thus, the openings 28, 30 overlap the openings in the adjacent side links. The shorter axis or height 'C' of each opening 28, 30, however, is the same as the diameter "B." As seen in FIGS. 3 and 4, this shape of the pin openings 28 and 30 assures that the tensile load on the chain 10 is assumed totally by the tie links 16 and cutter links 18 and none is imposed on the wear links 26. On the other hand, the hard wear links 26 mounted beside the side links resist abrasion by the rail surfaces 19 and 21 to lengthen the life of the chain.

Figure 7:
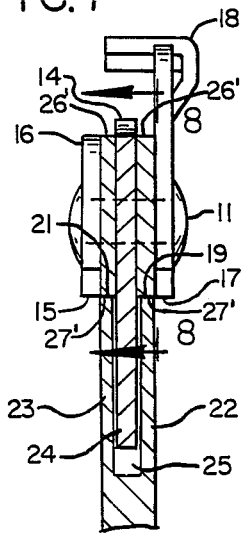
FIG. 7 is an enlarged cross-sectional view taken along line 7—7 of FIG. 5.
Figure 8:
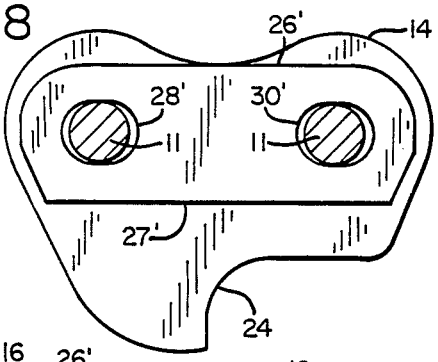
FIG. 8 is a cross-sectional view taken along line 8—8 of FIG. 7.
Figure 6:
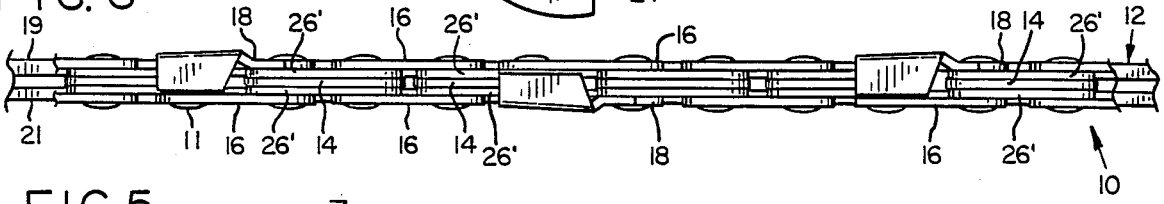
FIG. 6 is a top plan view of the saw chain shown in FIG. 5.
Figure 5:
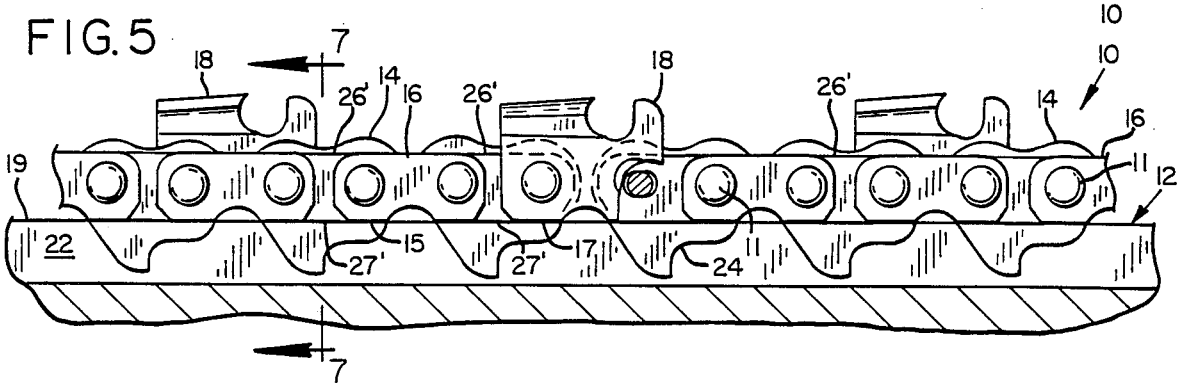
FIG. 5 is a side view, partly in section, of a second embodiment of the invention mounted on a saw bar.

FIG. 5–8 show a second embodiment of the invention, wherein wear links 26' are mounted on both sides of the drive links 14. As best seen in FIGS. 6 and 7, the contour of the underside 27' of the links 26' is a straight line that is aligned with the undersides 15 and 17 of the overlapping side links 16, 18 for riding on rail surfaces 19 and 21. FIG. 8 shows the oblong pin openings 28' and 30' in the wear links 26' to allow the adjacent drive link 14 to assume the tensile load on the chain while the wear links 26' support the chain on the bar.

Wear links 26, 26' thus may be selectively mounted beside side links or beside drive links in the manner disclosed to improve the chain's resistance to abrasion from the bar 12. It should be understood, however, that the links 26, 26' may be mounted to the chain 10 in other patterns as well and still improve resistance to abrasion and lengthen the useful life of the chain.

Having illustrated and described the principles of the invention in preferred embodiments, it should be apparent to those skilled in the art that the invention can be modified in arrangement and detail without departing from such principles. I claim all modifications coming within the spirit and scope of the following claims.

I claim:

1. In a saw chain having drive links and side links formed of steel pivotally interconnected by pin means extending through circular openings in said links, the drive links being constructed to ride in a center groove of a saw bar and the undersides of the side links being constructed to ride along the outer surfaces of a pair of parallel rails defining the groove, each side link receiving a pair of said pin means, the improvement comprising a plurality of wear links mounted one adjacent each of said side links and slidingly engaging said rails, each of said wear links having a pair of openings receiving said pair of pin means connecting the adjacent side link in the chain, said wear links being formed of a material having greater resistance to abrasion than said steel.

2. The saw chain of claim 1 in which said openings of said wear links are oblong and have a length along an axis extending longitudinally of said chain greater than the diameter of said circular openings, said oblong pin openings in a wear link having the same center-to-center spacing as that of said side link openings, whereby the tensile load on said chain will not be imposed on said wear links but will be taken by said side links.

3. The saw chain of claim 1 in which each wear link is mounted beside each side link and between the drive link and the side link.

4. The saw chain of claim 1 in which the wear link material is a cobalt chromium alloy having a greater resistance to abrasion than steel.

5. In a saw chain having drive links and side links formed of steel pivotally interconnected by pin means extending through circular openings in said links, the drive links being constructed to ride in a center groove of a saw bar and the undersides of the side links being constructed to ride along the outer surfaces of a pair of parallel rails defining the groove, the improvement comprising a plurality of wear links mounted one beside each side link for riding along the outer surfaces of the rails, said wear links being formed of a material having greater resistance to abrasion than said steel, said wear links further having oblong pin openings having a length along an axis extending longitudinally of the chain greater than the diameter of said circular openings, said oblong pin openings in a wear link having the same center-to-center spacing as that of said side link openings, whereby the tensile load on said chain will not be imposed on said wear links but will be taken by said side links.

6. In a saw chain having drive links and side links formed of steel pivotally interconnected by pin means extending through circular openings in said links, the drive links being constructed to ride in a center groove of a saw bar and the undersides of the side links being constructed to ride along the outer surfaces of a pair of parallel rails defining the groove, each drive link receiving a pair of said pin means, the improvement comprising a plurality of wear links mounted one adjacent each side of said drive links and slidingly engaging said rails, each of said wear links having a pair of openings receiving said pair of pin means connecting the adjacent drive link in the chain, said wear links being formed of a material having greater resistance to abrasion than said steel.

7. The saw chain of claim 6 in which said openings of said wear links are oblong and have a length along an axis extending longitudinally of said chain greater than the diameter of said circular openings, said oblong pin openings in a wear link having the same center-to-center spacing as that of said drive link openings, whereby the tensile load on said chain will not be imposed on said wear links but will be taken by said drive links.

8. A wear link for saw chain, said chain having drive links and side links formed of steel pivotally interconnected by pin means extending through circular openings in said links, the drive links being constructed to ride in a center groove of a saw bar and the undersides of the side links being constructed to ride along the outer surfaces of a pair of parallel rails defining the groove, the wear link being constructed for mounting on the chain for engaging said rail and being formed of a material having greater resistance to abrasion than said steel, said wear link having oblong pin openings having a length along an axis extending longitudinally of said chain greater than the diameter of said circular openings, said oblong pin openings in the wear link having the same center-to-center spacing as that of said drive link and drive openings, whereby the tensile load on said chain will not be imposed on said wear link when mounted on said chain but will be taken by said drive and side links.

9. The wear link of claim 8 in which the contour of its underside matches the contour of the underside of said side links in said chain.

10. The wear link of claim 8 in which the link is constructed for mounting beside a side link between said side link and a drive link.

11. The wear link of claim 8 in which the link is constructed for mounting beside a drive link.

* * * * *